US010247202B2

(12) United States Patent
Mikkelsen

(10) Patent No.: US 10,247,202 B2
(45) Date of Patent: Apr. 2, 2019

(54) CENTRIFUGAL PUMP

(71) Applicant: Grundfos Holding a/s, Bjerringbro (DK)

(72) Inventor: Steen Mikkelsen, Bjerringbro (DK)

(73) Assignee: Grundfos Holding a/s, Bjerringbro (DK)

( * ) Notice: Subject to any disclaimer, the term of this patent is extended or adjusted under 35 U.S.C. 154(b) by 385 days.

(21) Appl. No.: 13/721,243

(22) Filed: Dec. 20, 2012

(65) Prior Publication Data

US 2013/0164125 A1 Jun. 27, 2013

(30) Foreign Application Priority Data

Dec. 22, 2011 (EP) ..... 11195186

(51) Int. Cl.

| | |
|---|---|
| ***F04D 1/00*** | (2006.01) |
| ***F04D 29/62*** | (2006.01) |
| ***F04D 1/06*** | (2006.01) |
| ***F04D 29/42*** | (2006.01) |

(52) U.S. Cl.

CPC ..... *F04D 29/628* (2013.01); *F04D 1/00* (2013.01); *F04D 1/066* (2013.01); *F04D 29/4293* (2013.01)

(58) Field of Classification Search

CPC .. F04D 29/426; F04D 29/628; F04D 29/4293; F04D 1/06; F04D 1/066

USPC ..... 417/423.14, 424.1, 424.2; 415/182.1, 415/198.1, 203, 204, 205, 206

See application file for complete search history.

(56) References Cited

U.S. PATENT DOCUMENTS 4,135,852 A * 1/1979 Archibald ..... F04D 7/045 415/121.2
4,802,819 A * 2/1989 Bevington ..... F04D 29/628 415/199.3
6,000,915 A * 12/1999 Hartman ..... F04D 1/06 166/105

(Continued)

FOREIGN PATENT DOCUMENTS

DE 1275866 B 8/1968
DE 9310091 U1 9/1993

(Continued)

OTHER PUBLICATIONS

Search Report dated Jun. 25, 2012 in EP Application No. 11195186.9.

*Primary Examiner* — Justin Seabe
*Assistant Examiner* — Jason Mikus
(74) *Attorney, Agent, or Firm* — Panitch Schwarze Belisario & Nadel LLP

(57) ABSTRACT

A centrifugal pump (1) includes at least one pump stage (2) and a first housing part (3) having a suction connection (5). A second housing part (6) has a pressure connection (7). At least one intermediate housing part (10) at least in sections delimits a channel (11) leading to a pressure side of the at least one pump stage (2). The pump further includes a third housing part (20). The second housing part (6) and the at least one intermediate housing part (10) are arranged between the first and the third housing part (3, 20). The at least one intermediate housing part (10) and the second housing part (6) are configured to be arranged in at least two different positions with respect to the first and the third housing (3, 20).

8 Claims, 3 Drawing Sheets

(56) References Cited

U.S. PATENT DOCUMENTS

| | | | | |
|---|---|---|---|---|
| 6,361,272 | B1 * | 3/2002 | Bassett | E21B 43/128 415/121.1 |
| 6,428,288 | B1 * | 8/2002 | King | 417/366 |
| 2002/0187037 | A1 * | 12/2002 | Lee | E21B 43/128 415/1 |
| 2008/0085185 | A1 * | 4/2008 | Towsley et al. | 415/198.1 |
| 2008/0292454 | A1 | 11/2008 | Brunner | |
| 2009/0016899 | A1 * | 1/2009 | Davis | E21B 43/129 417/133 |
| 2010/0221105 | A1 * | 9/2010 | Markovitch | F04D 13/10 415/199.1 |
| 2012/0251308 | A1 * | 10/2012 | Mikkelsen | F04D 1/063 415/198.1 |

FOREIGN PATENT DOCUMENTS

| | | | |
|---|---|---|---|
| GB | 2013279 | A | 8/1979 |
| JP | 58-144689 | A | 8/1983 |

* cited by examiner

CENTRIFUGAL PUMP

BACKGROUND OF THE INVENTION

The present invention relates generally to a centrifugal pump with at least one pump stage.

Centrifugal pumps with one or more stages are known in the state of the art and are widespread due to their simple and robust construction manner.

With such pumps, there are different construction forms. With the inline pumps, the pressure outlet and suction inlet are arranged on the same axis in the foot of the pump. However, pumps are also known, with which the suction inlet is arranged in the pump foot and the pressure outlet in a separate component close to the upper end of the pump. Thus, although as a rule, the housing parts can be applied for pumps of different pressure stages, the arrangement of the suction inlet and pressure outlet to one another, however, always necessitates a change of the respective components, which increases the variant of parts on manufacture, storage and stocking of replacement parts.

BRIEF SUMMARY OF THE INVENTION

Against the above background, it is an objective of a preferred embodiment of the present invention, to design a centrifugal pump of the known type, in particular a multi-stage centrifugal pump, such that different connection variants can be constructed with as many as possible equal parts.

According to a preferred embodiment of the present invention, the above objective is achieved by a centrifugal pump having at least one pump stage and a multi-part housing with a first housing part including a suction connection with a second housing part including a pressure connection. At least one intermediate housing part at least in sections delimits a channel leading to the pressure side of the at least one pump stage. The second housing part and the at least one intermediate housing part are arranged between the first and a third housing part. The at least one intermediate housing part and the second housing part are designed for arrangement in at least two different positions with respect to the first and the third housing part. With the configuration according to a preferred embodiment of the present invention, the degree of freedom for the positioning of the second housing part including the pressure connection is increased. By way of this, in particular the pressure connection can be arranged in different positions, without changing the components with regard to their design. Advantageous further formations of the invention are defined and specified in the subsequent description and drawings.

A basic concept of a preferred embodiment of the present invention is to design the present housing parts, in particular the at least one intermediate housing part and the second housing part, such that these together or also individually can be arranged in different positions with respect to the first and the third housing part, so that with the same components, the pressure connection can be changed in its arrangement, without having to change the components.

In the simplest form, this can be realized by way of at least the second housing part being rotatably arranged about the longitudinal axis, in order to be able to vary the angle between the suction connection and the pressure connection.

According to a preferred embodiment of the present invention, the at least one intermediate housing part and the second housing part are designed for arrangement in at least two different longitudinal positions with respect to the impeller axis of the pump. With this design of the centrifugal pump, a changeable positioning of the pressure connection, in particular in the axial and, as the case may be, also in the radial direction of the centrifugal pump is made possible. The centrifugal pump is more flexible and an improved adaptation to different installation situations can be realized due to the increased degrees of freedom in the positioning of the pressure connection to the suction connection. Expensive deflection pieces and conduits can be spared, since the second housing part comprising the pressure connection, and the intermediate housing part can be arranged in any sequence, which in particular means that due to this configuration, the pressure connection with regard to the centrifugal pump can be arranged at the top or further to the bottom and independently of the stages of the centrifugal pump.

According to a preferred embodiment of the present invention, the at least one intermediate housing part has an essentially hollow-cylindrical shape and delimits the channel which is formed between the pressure side of the at least one pump stage and the pressure connection and which is designed as an angular channel in this region, to the outside.

According to a further preferred embodiment of the present invention, the at least one intermediate housing part and/or the second housing part including the pressure connection are fastenable at different rotational positions with regard to the impeller axis.

Preferably, the at least one intermediate housing part and the second housing part comprising the pressure connection, on at least one side which connects to a further housing part, are designed equally with regard to connection.

According to a further preferred embodiment of the present invention, the at least one intermediate housing part and the second housing part comprising the pressure connection, at two sides which each connect to a further housing part, are designed the same with regard to the connection. This permits an infinite arrangement of the individual components to one another.

It is particularly preferable if the at least one intermediate housing and the second housing part comprising the pressure connection are constructed in a modular manner.

Preferably, the at least one intermediate housing part and the second housing part comprising the pressure connection are clamped in between the first and the third housing part.

According to a further preferred embodiment of the present invention, two housing parts are connected or attached with a sealing ring, such as an O-ring, therebetween.

Moreover, it is preferable if the connections between adjacent housing parts are designed in a manner such that the housing outer walls are aligned to one another and the face-side end of one housing part engages with a positive fit into a face-side end, which is widened with respect to this, of the housing part connecting thereto.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
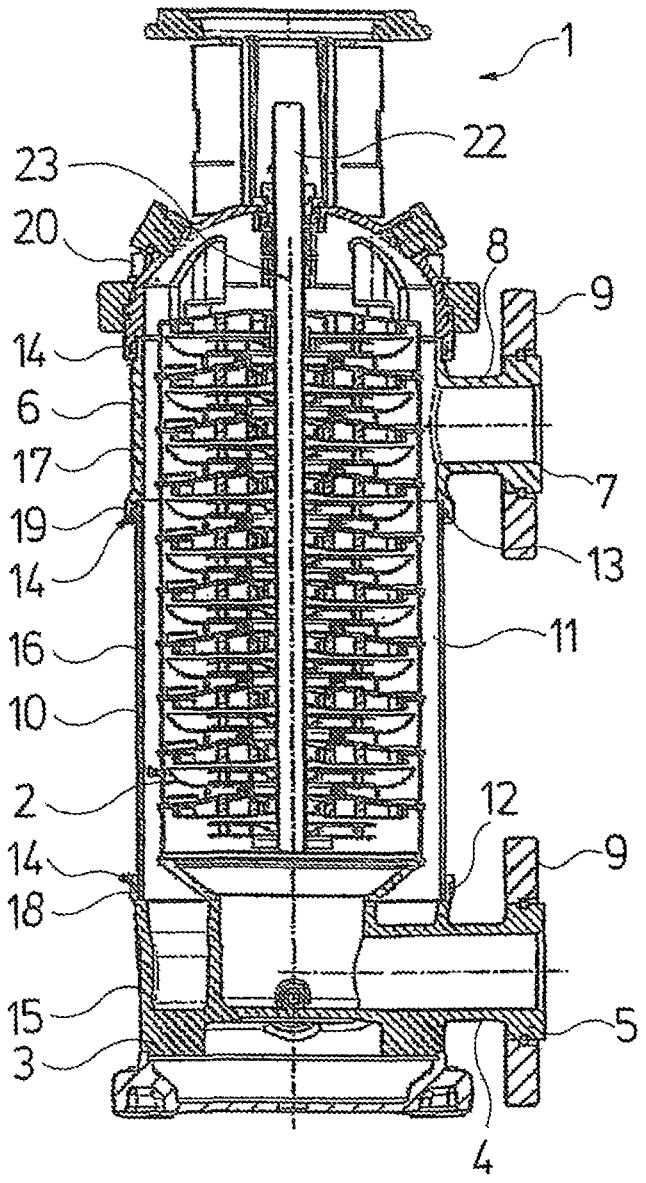
FIG. 1 is a cross-sectional elevational view a centrifugal pump according to a preferred embodiment of the present invention.

Certain terminology is used in the following description for convenience only and is not limiting. The words "lower," "bottom" and "top" directions in the drawings to which reference is made. Unless specifically set forth herein, the terms "a," "an" and "the" are not limited to one element, but instead should be read as meaning "at least one." The terminology includes the words noted above, derivatives thereof and words of similar import.

Referring to the drawings in detail, wherein like numerals indicate like elements throughout the several views, FIG. 1 shows a section through a centrifugal pump 1 according to one preferred embodiment of the present invention. The centrifugal pump 1 is designed in a multi-stage manner with ten pump stages 2, which are not described in detail any further herein. Alternatively, the centrifugal pump 1 can be designed, for example, with twelve pump stages 2 or any infinite other number of pump stages 2.

The centrifugal pump 1 includes a first housing part 3 provided with a suction connection 5 which includes a suction inlet 4 and through which a fluid to be delivered enters into the centrifugal pump 1. A pressure connection 7 with a pressure outlet 8, through which the fluid to be delivered exits from the centrifugal pump 1, is provided on a second housing part 6. The suction connection 5 as well as the pressure connection 7 is provided with respective connection flanges 9. An intermediate housing part 10, which is designed in a hollow-cylindrical manner, is arranged between the first housing part 3 and the second housing part 10.

The intermediate housing part 10 delimits a channel 11 which is formed by the pump stages 2 and the pressure connection 7 and which in this region is designed as an annular channel, on the outside. The intermediate housing part 10 and the second housing part 6 include the pressure connection 7 in the present embodiment, at two sides which each connect to a further hosing part, are designed the same with regard to the connection, for example, they are designed so as to be connectable to one another, into a unit. As is recognizable in FIG. 1, the first housing part 3 is connected to a lower end 12 of the intermediate housing part 10, and the second housing part 6 is connected to an upper end 13 of the intermediate housing part 10. Thereby, the connections between the respective adjacent housing parts are designed in a manner such that the housing outer wall 15 of the first housing part 3, the housing wall 16 of the intermediate housing part 10 and the housing outer wall 17 of the second housing part 6 are aligned to one another. Moreover, thereby, the face-side lower end 12 of the intermediate housing part 10 engages with a positive fit into an end 18, widened with respect to this, of the first housing part 3, and the face-side upper end 13 of the intermediate housing part 10 engages with a positive fit into an end 19, which is widened with respect to this, of the second housing part 6. In each case, sealing rings 14 for sealing and which here are designed as O-rings are provided at the respective connection sections.

In addition, the centrifugal pump 1 includes a third housing part 20 which forms the cover of the centrifugal pump 1 and is designed for the connection of the centrifugal pump 1 onto a motor (not shown here). The third housing part 20 is connected to the upper face-side end 21 of the second housing part 6, wherein here too the connection section is sealed by way of a sealing ring 14. A pump shaft 22 which is drivable by way of the motor not shown here, which engages through the individual pump stages 2 and ends in the third housing part 20, is arranged centrally along the longitudinal axis of the centrifugal pump 1 and thus forms the impeller axis 23.

Figure 2A:
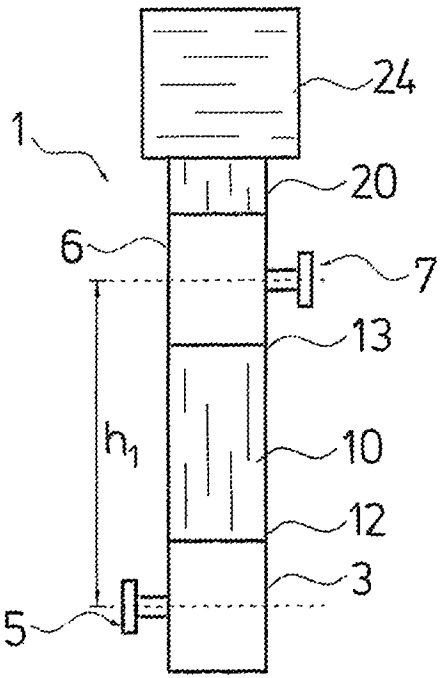
FIGS. 2A, 2B, 2C are respective schematic representations of differently configured centrifugal pumps according to preferred embodiments of the present invention.
Figure 2B:
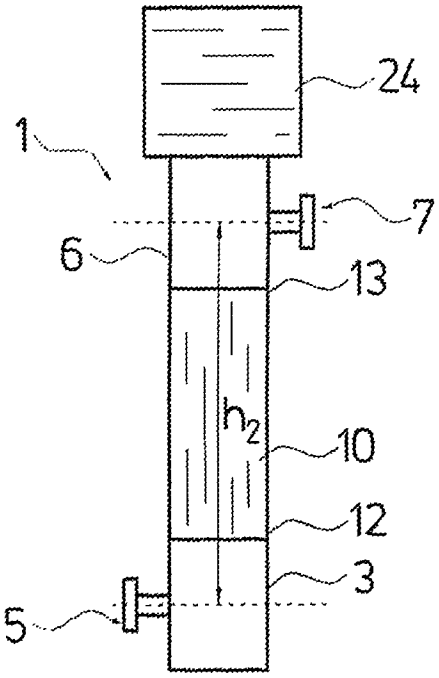
Figure 2C:
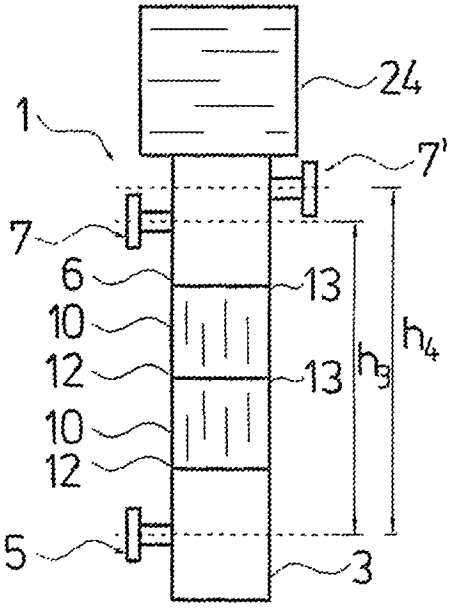

FIG. 2A, 2B, 2C in each case show schematic representations of differently configured centrifugal pumps 1 according to preferred embodiments of the present invention, in order to illustrate the variable axial distancing of the first housing part 3 containing the suction connection 5, to the second housing part 6 containing the pressure connection 7, the distancing being able to be realized by way of the configuration, according to a preferred embodiment of the present invention, of the centrifugal pump 1 and its modular construction. Moreover, according to the preferred embodiments represented here, apart from the axial variability due to the provision of the channel 11 as an annular channel, as has been described with regard to FIG. 1, a variable positioning of the pressure connection 7 provided on the second housing part 6, is also possible in the radial direction. Thus, the position of the pressure connection 7 can be adapted flexibly to the respective installation conditions, independent of the geometry and the height of the pump stages 2 (see FIG. 1).

As is represented in FIG. 2A, the centrifugal pump 1 according to the present embodiment includes a first housing part 3 with a suction connection 5 which is connected to the lower end 12 of an intermediate housing part 10. In turn, the second housing part 6, which includes the pressure connection 7, is arranged on the upper end 13 of the intermediate housing part 10. A third housing part 20 is arranged between the second housing part 6 and the motor 24. The suction connection 5 and the pressure connection 7 are distanced to one another by a first distance $h_1$.

The preferred embodiment represented in FIG. 2B differs from the preferred embodiment represented in FIG. 2A in that here, the intermediate housing part 10 is designed with a greater length, so that the suction connection 5 is distanced to the pressure connection 7 by a second distance $h_2$. A further difference is the fact that in the embodiment represented in FIG. 2B, the motor 24 is connected directly onto the second housing part 6, without a third housing part 20 being located therebetween, as is represented in FIG. 2A.

The preferred embodiment represented in FIG. 2C differs from the preferred embodiments represented previously in FIGS. 2A and 2B in that here, instead of a single pressure connection 7 on the second housing part 6, two pressure connections 7, 7' are provided and moreover two intermediate housing parts 10 are arranged between the first housing part 3 and the second housing part 6. A third distance $h_3$ for the first pressure connection 7, and a fourth distance $h_4$ for the second pressure connection 7', result by way of this.

Figure 3:
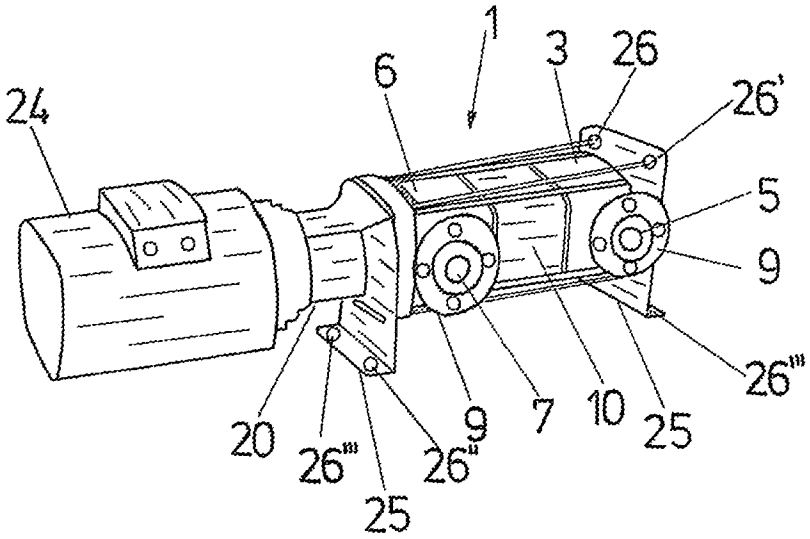
FIG. 3 is a perspective view of a centrifugal pump according to a preferred embodiment of the present invention.

FIG. 3 shows a perspective view of a centrifugal pump 1 according to a preferred embodiment of the present invention. As is recognizable here, the centrifugal pump 1 includes a first housing part 3 with a suction connection 5, and intermediate housing part 10, a second housing part 6 with pressure connection 7 and a third housing part 20, onto which a motor 24 is connected. All housing parts are fixed on one another by way of several tie rods, for example, clamping screws.

Moreover, the housing parts are clamped in an installation module 25. By way of the installation module 25, the centrifugal pump 1 is fixable in a desired position by way of screws which can be led through the holes 26, 26', 26", 26", 26". The centrifugal pump 1 can be adapted to almost any installation situation on account of the modularity of the housing of the centrifugal pump 1 and the flexibility obtained by way of this, with regard to the position of the pressure connection 7.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A centrifugal pump (1) comprising:

at least one centrifugal pump stage (2);

a first housing part (3) having a suction connection (5) that includes a suction inlet through which fluid to be delivered enters the centrifugal pump;

a second housing part (6) having a pressure connection (7) that includes a pressure outlet through which the fluid to be delivered exits the centrifugal pump, at least one intermediate housing part (10) which delimits a channel (11) leading to a pressure side of the at least one centrifugal pump stage (2), the channel being an annular flow channel that is radially arranged between the at least one centrifugal pump stage and the at least one intermediate housing part and through which the fluid to be delivered flows; and a third housing part (20), wherein the second housing part (6) and the at least one intermediate housing part (10) are arranged between the first housing part (3) and the third housing part (20), and wherein the at least one intermediate housing part (10) and the second housing part (6) are each displaceable and configured to be arranged in at least two different positions with respect to the first housing part (3) and the third housing part (20).

2. The centrifugal pump (1) according to claim 1, wherein the at least one intermediate housing part (10) and the second housing part (6) are each displaceable and configured to be arranged in at least two different longitudinal positions with respect to an impeller axis (23) of the centrifugal pump.

3. The centrifugal pump (1) according to claim 1, wherein the at least one intermediate housing part (10) has an essentially hollow-cylindrical shape and on an outside of the at least one intermediate housing part delimits the channel (11) which is formed between the pressure side of the at least one centrifugal pump stage (2) and the pressure connection (7).

4. The centrifugal pump (1) according to claim 1, wherein the at least one intermediate housing part (10) or the second housing part (6) having the pressure connection (7) is fastenable at different rotation positions with respect to an impeller axis (23).

5. The centrifugal pump (1) according to claim 1, wherein the at least one intermediate housing part (10) and the second housing part (6) having the pressure connection (7) are constructed in a modular manner.

6. The centrifugal pump (1) according to claim 1, wherein the at least one intermediate housing part (10) and the second housing part (6) having the pressure connection (7) are clamped between the first housing part (3) and the third housing part (20).

7. The centrifugal pump (1) according to claim 1, wherein two housing parts are connected amid integration of a sealing ring (14).

8. The centrifugal pump (1) according to claim 1, wherein connections are formed between adjacent housing parts (3, 6, 10, 20) in a manner such that housing outer walls (15, 16, 17) of the first, second and third housing parts are aligned to one another, and wherein a face-side end of one housing part (3, 6, 10, 20) engages with a positive fit into a face-side end of the housing part (3, 6, 10, 20) connected thereto.

* * * * *